United States Patent [19]

Jungwirth et al.

[11] Patent Number: 4,640,068

[45] Date of Patent: Feb. 3, 1987

[54] ANCHORING AND COUPLING DEVICE FOR TENDONS IN PRESTRESSED CONCRETE

[75] Inventors: Dieter Jungwirth; Also Mannhart, both of Munich, Fed. Rep. of Germany

[73] Assignee: Dycherhoff & Widmann Ag, Munich, Fed. Rep. of Germany

[21] Appl. No.: 510,077

[22] Filed: Jun. 30, 1983

[30] Foreign Application Priority Data

Jul. 2, 1982 [DE] Fed. Rep. of Germany ..... 3224702

[51] Int. Cl.[4] ..... E04C 5/08; E04C 3/26; F16G 11/00

[52] U.S. Cl. ..... 52/223 L; 52/230; 24/122.6

[58] Field of Search ..... 52/230, 223 L, 698, 52/223 R; 405/259, 260, 262; 24/122.6

[56] References Cited

U.S. PATENT DOCUMENTS

| | | | |
|---|---|---|---|
| 3,412,511 | 11/1968 | Dietrich | 52/223 L |
| 3,524,228 | 8/1970 | Kelly | 52/230 |
| 3,658,296 | 4/1972 | Yegge | 52/230 |
| 3,820,832 | 6/1974 | Brandestine et al. | 52/230 |
| 3,843,288 | 10/1974 | Howlett et al. | 52/223 L |
| 3,863,302 | 2/1975 | Walbergen et al. | 52/223 L |
| 3,967,421 | 7/1976 | Dufossez | 52/230 |
| 4,023,242 | 5/1977 | Caro Roqueta | 52/230 |
| 4,192,114 | 3/1980 | Jungwirth et al. | 52/230 |
| 4,223,497 | 9/1980 | Edwards | 52/230 |
| 4,348,844 | 9/1982 | Schupack et al. | 52/230 |
| 4,363,462 | 12/1982 | Wlodkowski et al. | 52/230 |
| 4,367,568 | 1/1983 | Weiser | 24/122.6 |
| 4,449,855 | 5/1984 | Langwadt | 405/260 |

FOREIGN PATENT DOCUMENTS

| | | | |
|---|---|---|---|
| 2360667 | 6/1974 | Fed. Rep. of Germany | 52/230 |
| 2423741 | 11/1975 | Fed. Rep. of Germany . | |
| 2911437 | 10/1980 | Fed. Rep. of Germany | 52/223 L |
| 444441 | 2/1968 | Switzerland | 52/230 |
| 482080 | 1/1970 | Switzerland | 52/230 |

*Primary Examiner*—Carl D. Friedman
*Assistant Examiner*—Michael Safavi
*Attorney, Agent, or Firm*—Toren, McGeady and Goldberg

[57] ABSTRACT

An anchoring device for a prestressing location can also serve as a coupling location for tendons in prestressed concrete where a subsequent bond is provided for the tendons. The anchoring device includes an anchoring member containing a plurality of bores divided into two separate groups, with each group arranged to anchor individual tendon elements extending into the anchoring member from an opposite direction. Each bore has an axially extending frusto-conical section and a cylindrical section extending from the smaller diameter end of the frusto-conical section. The frusto-conical sections in one group of bores are axially offset from the frusto-conical sections in the other group of bores. The bores in one group are filled with a plastic corrosion protection material, such as grease. Such corrosion protection material ensures a continuously active wedge-anchoring system which facilitates the movement of the wedges under full load conditions while providing a short bond-free length in the cylindrical section affording compensation for the time-dependent slippage of the anchoring device. A similar arrangement of the anchoring device can be used as a coupling device along the length of a tendon.

6 Claims, 8 Drawing Figures

20
4
21
22
9
35
32
31
33
36
6
III
III
19
19
17
20
34
4
II
II
1
3
2

ANCHORING AND COUPLING DEVICE FOR TENDONS IN PRESTRESSED CONCRETE

SUMMARY OF THE INVENTION

The present invention is directed to an anchoring device for use at a tensioning or prestressed location which simultaneously serves as a coupling location, and it also relates to a coupling device for tendons used in prestressed concrete made up of a plurality of individual elements, such as strands, wires and the like.

In the construction of long concrete structures it is not always possible for the individual tendons to extend between the opposite end faces of the structure, rather, it is necessary in many instances to provide intermediate anchoring systems to which the continuous tendons are attached. Such a situation is particularly true where a prestressed concrete bridge is constructed in sections. These tendon couplings are provided to transmit safely the stressing loads of the tendons to each new section from the ends of the tendons in the previously poured section. Further, it is desired that the stress from the prestressing load on the tendons can build up with as little interference as possible primarily in the joint between two separately poured sections, that is, the so-called coupling joint.

In a known anchoring device, the anchoring member is in the form of a disk with frusto-conical bores for anchoring the individual outgoing elements which are located outwardly from the bores anchoring the individual incoming elements, note German Offenlegungsschrift No. 24 23 741. The anchoring planes for the individual incoming and outgoing elements practically coincide. A tubular spacer extends between the anchoring disk and an abutment member, so that a free space is provided whereby the wedges for anchoring the individual outgoing elements can be inserted into the bores provided for them. The space requirement for this anchoring device made up of many individual parts, is relatively large. Moreover, the wedges of the individual outgoing elements must be secured individually to prevent any unintentional loosening or release of the wedges during the period between the insertion of the tendons and their tensioning. Since the individual outgoing elements are anchored radially outwardly from the individual incoming elements, there is the danger of that the anchoring disk will be deformed in the manner of a bowl along with a slight time-dependent slippage of the wedge anchors in the coupling joint and such deformation may lead to the development of cracks.

In another known anchoring device of this general type, as shown in German Offenlegungsschrift No. 29 11 437, by placing the anchoring disk immediately against the coupling joint it is possible to limit the length of the anchor and to prevent the decrease of stress in the coupling joint because the surrounding concrete is shortened due to shrinkage and creep. The conical bores for the individual outgoing elements are located radially outwardly from the bores for the individual incoming elements and all of the elements are anchored in approximately one plane. The wedges for the individual outgoing elements are secured by compression springs which bear against a cover. In this arrangement, there is the danger that deformation of the anchoring disk may result whereby time-dependent slippage, although slight, immediately leads to cracks in the coupling joint.

Both of these known anchoring devices have the disadvantage that, after injecting grout into the tendon ducts, the wedges are fixed by the grout and, with increasing stressing force, are prevented from moving up, so that the ultimate or failure load cannot be reached.

Therefore, it is the primary object of the present invention to assure that, in an anchor of the above-described type, cracks are essentially avoided in the coupling joint and there is no interference with the moving up of the wedges, whereby the ultimate load-bearing capacity can be reached.

In accordance with the present invention, the desired object is attained in an anchoring device of the above-described type so that the bores have, in addition to frusto-conical portions for receiving the anchoring wedges, a cylindrical portion adjoining the smaller diameter end of the frusto-conical sections. The frusto-conical sections for the different groups of incoming and outgoing elements are offset relative to one another in the manner of an overlapping joint. The bores for the individual outgoing elements are filled with a permanently plastic, lubricating corrosion protection material, preferably grease. An end plate is provided on the face surface of the anchoring member from which the individual outgoing elements extend. This plate is removable so that the individual outgoing elements can be inserted.

Advantageously, the cylindrical portions of the bores for the individual outgoing elements are closed by removable closure plugs. The closure plugs can be molded with or formed integrally on the end plate and the plugs can be provided with an exterior toothing for engagement within the bores.

It is advantageous if the closure plug and the end plate are formed of a plastics material, such as polyethylene.

In a coupling device for tendons used in prestressed concrete where the tendons are made up of a plurality of individual elements, such as strands, wires and the like, the invention resides in that, in addition to conical portions forming the support surfaces for the anchoring wedges, each bore has a cylindrical section adjoining the smaller diameter end of the frusto-conical section and the frusto-conical sections are disposed staggered or offset axially relative to one another in the manner of an overlapping joint. The bores for the individual incoming and outgoing elements are filled with a permanently plastic, lubricating corrosion protection material, preferably grease. Each of the opposite face surfaces of the anchoring member are covered by a cover plate and the cover plates are constructed to facilitate the insertion of the individual elements into the anchoring member.

For the subsequent insertion of the individual elements, the cover plates may be formed with breakthroughs having a diameter only slightly greater than the diameter of the individual elements.

In the anchoring device as well as in the coupling device, the bores for the individual incoming and outgoing elements are distributed uniformly across the cross-sectional area of the anchoring member, that is, the bores are in an alternating arrangement across the anchoring member.

One advantage of the present invention is that the anchoring region for the individual outgoing elements is not filled with grout for protection against corrosion, rather the wedges are completely embedded in a permanently plastic, lubricating corrosion protection material, such as grease. As a result, a continuously active wedge anchoring system is provided which facilitates the moving-up of the wedges under fully loaded conditions. Since the frusto-conical sections of the bores for the different groups of individual elements are offset relative to one another in the axial direction, adjoining cylindrical sections of the bores are formed which are also filled with grease. As a result, a short, bond-free length exists in the cylindrical sections of the bores for the individual outgoing elements and such elements are freely extendable so that the time-dependent slippage of the anchoring system can be compensated. Nevertheless, the anchoring device embodying the present invention has a very short structural length, so that additional prestressing losses due to shrinkage and creep of the concrete are avoided.

Another advantage of the invention is that, after the bores for the individual outgoing elements have been filled with the corrosion protection material, the elements can be inserted at any time after the anchoring, tensioning and injection of grout for the individual incoming elements, without any concern for corrosion damage. The bores and the corrosion protection material are protected by an end plate with closure plugs, with the end plate being removed when the individual outgoing elements are inserted. When the elements are inserted into the bores, the excess grease is discharged from the bores.

Based on the same principle, a tendon coupling can be constructed without an intermediate anchoring system. In such a coupling, the bores for the individual incoming elements as well as for the individual outgoing elements are filled with corrosion protection material and are covered with cover plates. The cover plates must have breakthroughs to facilitate the insertion of the individual elements.

The possibility of cracks developing at the coupling joint is also reduced if, in accordance with the present invention, the bores for the individual incoming and outgoing elements are uniformly distributed over the cross-sectional area of the anchoring member, whereby deformation of the anchoring member is avoided. Since the location of the frusto-conical sections of the bores of the individual adjacent incoming and outgoing elements are offset axially relative to one another, the distance between the bores can be reduced with a consequent reduction in the amount of material required.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 4A:
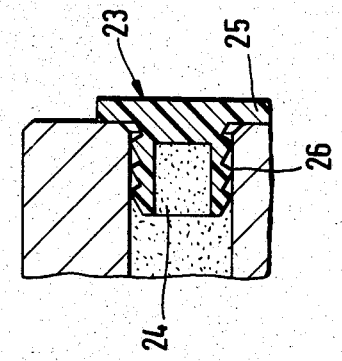
FIG. 4*a* is an enlarged detail view of the end plate and closure plug shown in FIG. 4.
Figure 4:
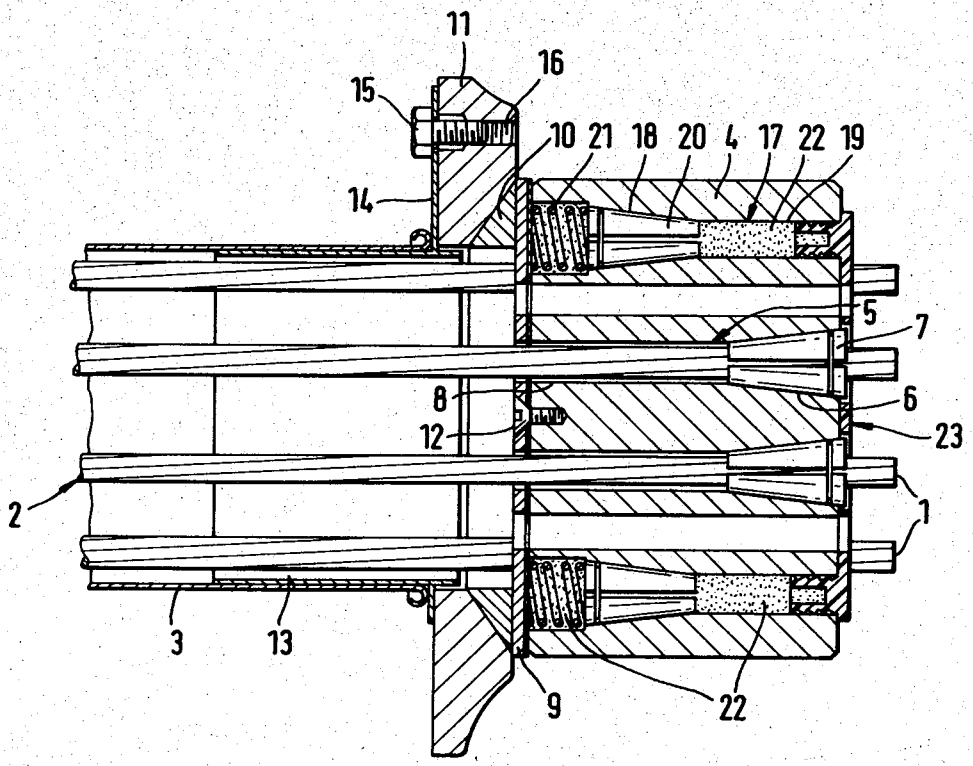
FIG. 4 is an axially extending view of the anchoring device embodying the present invention after the tensioning of the individual incoming elements and prior to the insertion of the individual outgoing elements.

As illustrated in FIG. 4, individual elements 1, such as strands of steel wire, of a prestressing tendon 2 guided in a sheathing tube 3, are anchored in an anchoring member 4. Each strand 1 extends through a bore 5 and each bore has a frusto-conical section formed to correspond to and provide the contact surfaces for a wedge 7. A cylindrical section 8, having a diameter corresponding to the smallest diameter of the frusto-conical section 6 extends from the smaller end of the frusto-conical section. The strand 1 is freely placed within the cylindrical section 8.

On the side of the anchoring member from which the elements 1 extend, that is the left-hand side as viewed in FIG. 4, a base plate 9 is positioned against the face surface of the anchoring member with a seal, such as a rubber layer. An intermediate ring 10 is positioned against the opposite side of the base plate 9 from the anchoring member 4. The intermediate ring 10 has a triangular cross-section and bears against an abutment member 11 either embedded in a structural concrete unit, not shown, or supported on such a unit. Base plate 9 is attached to the anchoring member 4 by a screw 12. The connection between the abutment member 11 and the sheathing tube 3 is effected by a tubular section 13 having a flange at its end adjacent the abutment member. The flange 14 of the sheathing tube is attached to the abutment member 11 by a screw 16 extending into a continuously threaded bore 16 in the abutment member 11.

In addition to the bores 5 for the incoming individual elements or strands 1, the anchoring member has additional bores 17 extending in generally parallel relation with the bores 5 for receiving the outgoing individual elements or strands. Each bore 17 has a frusto-conical section 18 and a cylindrical section 19 extending from the smaller diameter end of the frusto-conical section. As viewed in FIG. 4, the frusto-conical sections 6 of the bores 5 are located adjacent the right-hand face surface of the anchoring member 4 while the frusto-conical sections 18 of the bores 17 are located adjacent the left-hand face surface of the anchoring member. Frusto-conically shaped wedges 20 are inserted into the frusto-conical sections 18 and are secured in position by compression springs 21 extending between the base plate 9 and the larger diameter ends of the wedges. The bores 17 are filled with a permanently plastic, lubricating corrosion protection material, preferably a grease 22, and the ends of the bores formed by the cylindrical sections 18 are covered by an end plate 23 located on the righthand face surface of the anchoring member 4, note FIG. 4. The end plate 23 is formed of a plate 25 extending across the face surface of the anchoring member 4 but with a diameter slightly smaller than that of the anchoring member, so that a jack for prestressing the incoming individual elements or strands 1 can be supported against the anchoring member. Closure plugs 24 are formed integrally with or molded onto the plate 25. As can be seen in FIG. 4a, the closure plug has a serrated or toothed circumferential surface 26 which assures a secure engagement of the end plate 23 in the bores 17. End plate 23 is formed of a plastics material, for instance, polyethylene.

Figure 5:
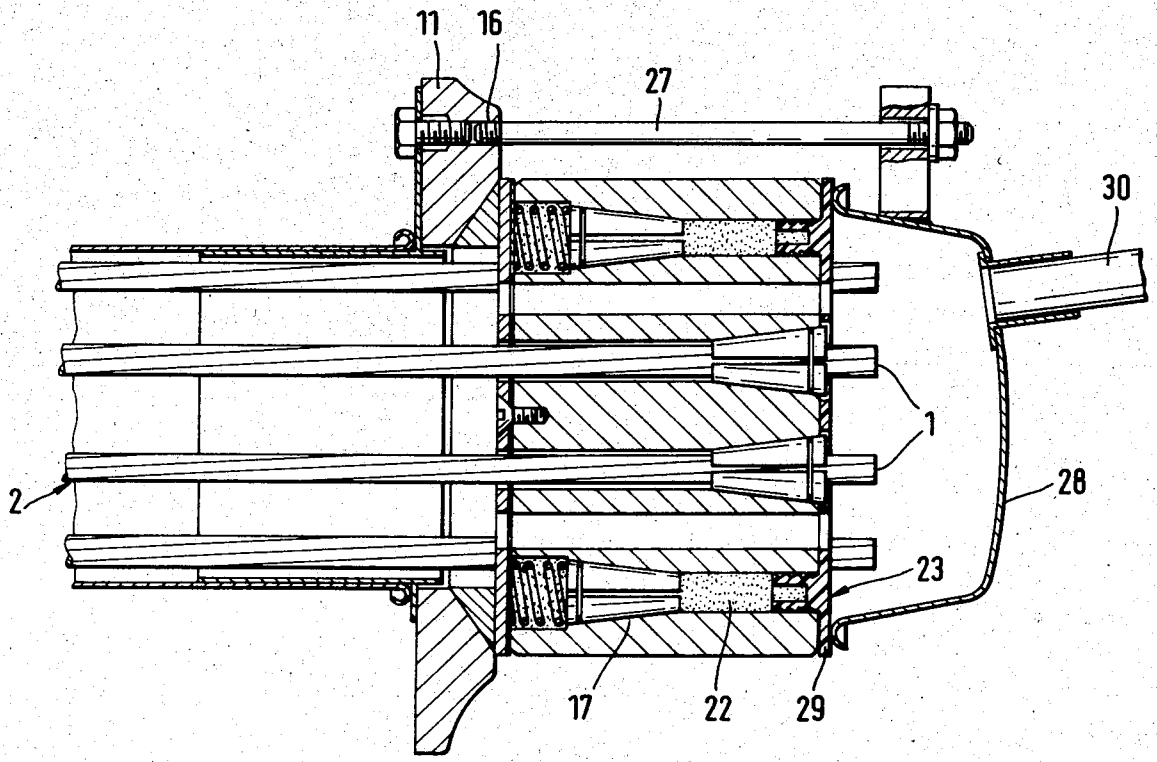
FIG. 5 is an axially extending sectional view of the anchoring device of the present invention prepared for the injection of grout.

The anchoring member 4 including base plate 9 and end plate 23 can be transported to a construction site in this form as a complete component. After prestressing the incoming individual elements 1 and anchoring the introduced prestressing load by means of the wedges 7, the incoming prestressing tendon 2 can be injected with grout. The anchoring device ready to be injected with grout is illustrated in FIG. 5. For the injecting operation, an injection bell 28 is pressed onto the right-hand face surface of the anchoring member 4, as viewed in FIG. 5 with the edge of the bell located outwardly from the circumferential edge of the end plate 23. A sealing plate 29 is positioned between the edge of the injection bell 28 and the face surface of the anchoring member 4. The bell is secured to the anchoring member 4 by tie rods 27 screwed into threaded bores 16 in the abutment member 11. An injection pipe can be attached to an injection socket on the bell for charging grout into the tendon 2. The grouting operation only affects the individual elements or strands 1 of the prestressing tendon 2, the grout does not enter into the bores 17 filled with corrosion protection material 22.

After the grout has hardened, the injection bell 28 is removed and the remaining grout on the end of the anchoring member 4 is knocked off. After removing the end plate 23 with its closure plugs 24, the strands 31 of the outgoing tendon 32 can then be inserted into the bores 17 filled with corrosion protection material 22. As the tendons 32 are inserted into the bores 17 excess grease 22 is forced out of the bores. Indicating or locating marks on each strand make it possible to check after the insertion operation if the individual elements have a sufficient depth of insertion into the bores.

Figures 1, 1A:
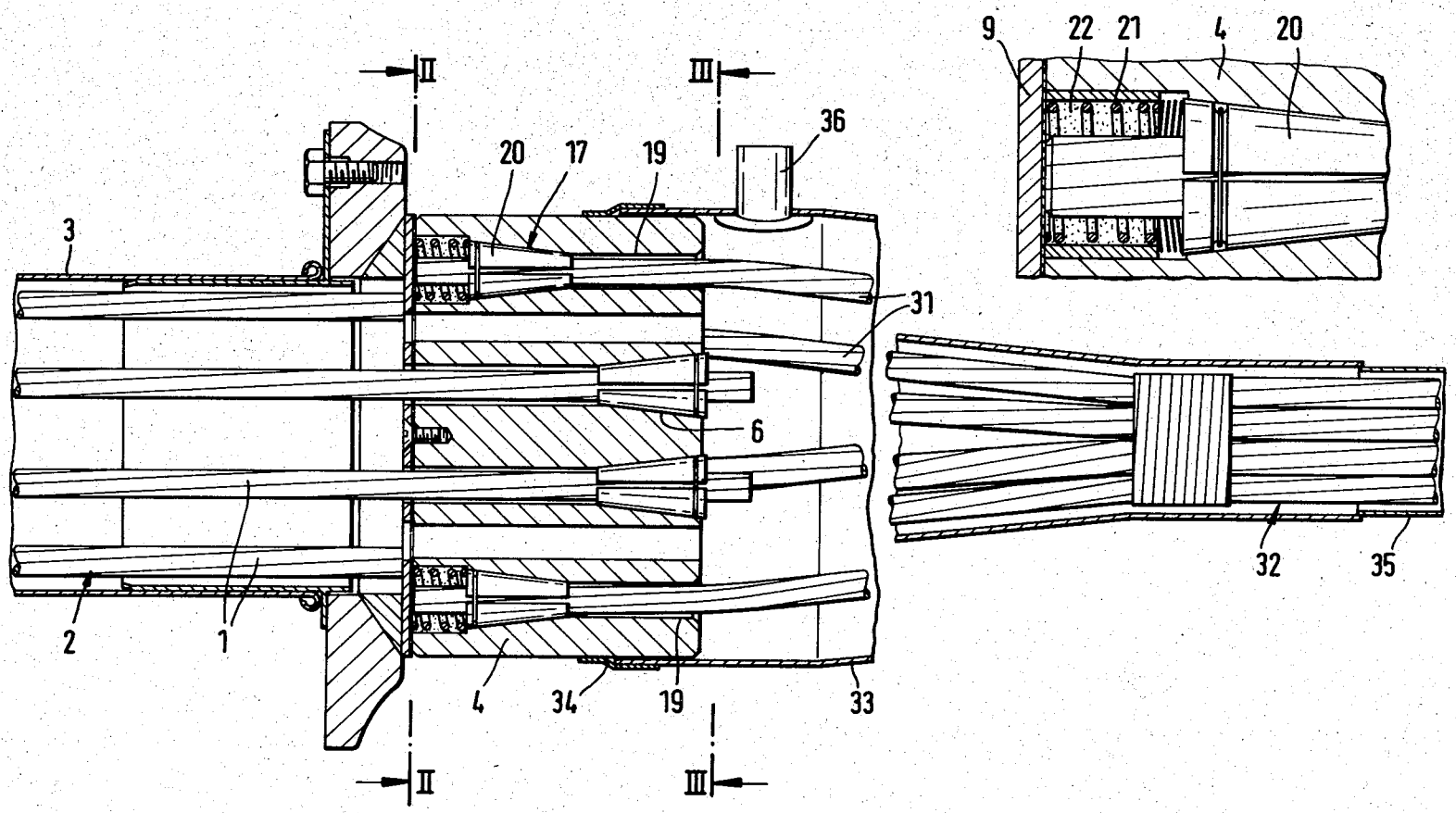
FIG. 1 is an axially extending section through an anchoring device embodying the present invention.
FIG. 1*a* is an enlarged detailed illustration of a wedge anchor in the anchoring device.
Figure 3:
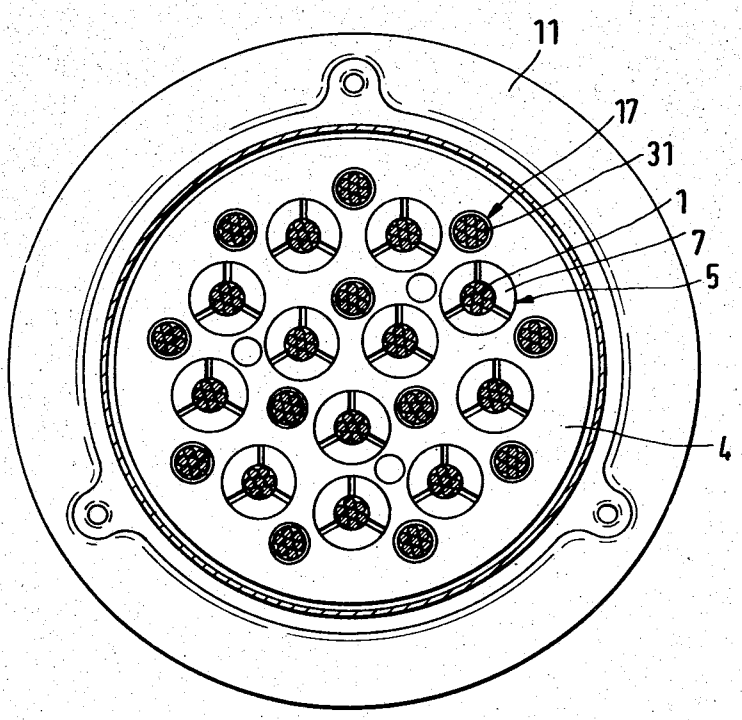
FIG. 3 is a cross-sectional view taken along the line III—III in FIG. 1.
Figure 2:
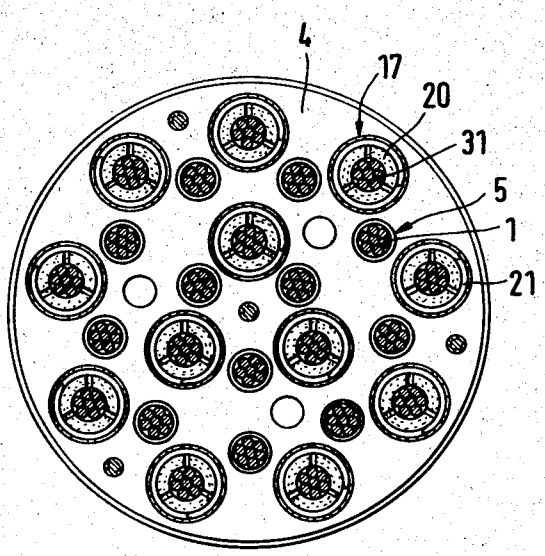
FIG. 2 is a cross-sectional view taken along the line II—II in FIG. 1.

Subsequently, in the assembly of the outgoing tendon 32, for its portion adjacent the anchoring member 4 which is spread out in a fan-like manner, a trumpet-shaped sheathing tube 33 is slid into place, note FIG. 1. The end of the tube 33 located around the outside surface of the anchoring member 4 is sealed by means of a jacket 34. The opposite end of the sheating tube 33 is connected to the normal sheathing tube 35 laterally enclosing the outgoing tendon 32, note the right-hand portion of FIG. 1. On the transition member or sheathing tube 33, a socket 36 is provided for use in injecting grout or for connection to a ventilating pump.

If grout is forced into the hollow space inside the sheathing tube 33, the grout cannot penetrate into the cylindrical sections 19 of the bores 17, and, accordingly, the outgoing individual elements or strands 31 remain fully movable along the short length of the cylindrical sections. In these portions of the bores 17, due to a time-dependent slippage of the wedges 20, in a manner of speaking the individual elements can breath so that cracks in the coupling joint are essentially avoided.

Figure 6:
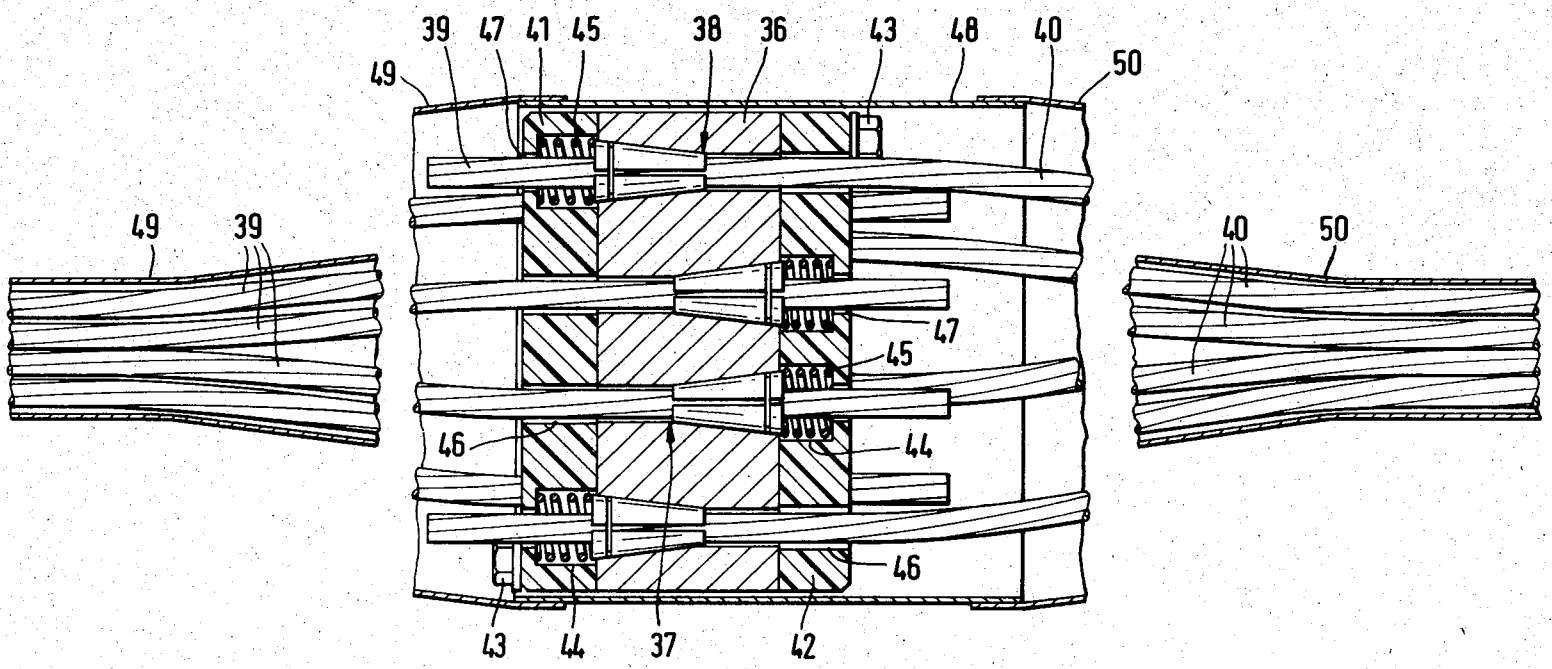
FIG. 6 is an axially extending sectional view through a coupling device embodying the present invention.

FIG. 6 illustrates another embodiment of the invention displaying a coupling device which is used without an intermediate anchoring system along the free length of a tendon.

The coupling device includes an anchoring member 36 with axially extending bores 37 for the incoming strands 39 and bores 38 for the outgoing strands 40. As set forth in the illustration of the anchoring device, each of the bores 37, 38 has a frustoconical section and a cylindrical section with the cylindrical section extending from the small diameter end of the frustoconical section. Before the coupling device is transported to a construction site, the bores 37, 38 are filled with a permanently plastic, lubricating corrosion protection material, preferably grease. The ends of the bores in the opposite face surfaces of the anchoring member 36 are closed by cover plates 41, 42 releasably secured on the anchoring member by screws 43.

The cover plates 42, 42 serve, on one hand, to close the ends of the bores 37, 38. On the other hand, the cover plates form recesses 44 in which spring elements 45 are positioned so that they press the wedges 20 into the frusto-conical sections of the bores 37, 38. The cover plates 41, 42 have breakthroughs 46 so that the strands 39, 40 to be anchored can be inserted into the cylindrical sections of the bores 37, 38 and into the wedges 20. In addition, cover plates 41, 42 have breakthroughs 47 arranged centrically relative to the recesses 44 so that the ends of the strands can extend outwardly after passing through the wedges 20.

The entire coupling device is laterally enclosed by a sheathing tube 48 with a trumpet shaped transition tubular section 49, 50 connected to each of the opposite ends of the sheathing tube. The transition tubular members 49, 50 surround the tendons along their normal free length.

We claim:

1. Anchoring device for a prestressing location also serving as a coupling location for prestressing tendons in a prestressed concrete structure with the tendons made up of a plurality of individual elongated elements such as strands, wires and the like, said tendons being bonded to the concrete structure subsequent to prestressing, said anchoring device comprising an anchoring member having a first face surface and a second face surface each facing in an opposite direction and disposed in spaced relation with a circumferentially extending side surface extending transversely of, around and between said first and second face surfaces, said anchoring member arranged to be supported against an abutment member, said anchoring member having a plurality of axially extending first and second bores therein with said first bores extending into said anchoring member from said first face surface to said second face surface and said second bores extending from said second face surface toward said first face surface, wedges positioned within said first and second bores for anchoring individual elements within said first and second bores, said first and second bores are shaped in the axial direction thereof for receiving said wedges therein, a first plate extending across said face surface and covering said first bores in said first face surface, means connecting said first plate to said anchoring member, spring elements in said first bores and bearing against said first plate and against said wedges in said first bores, wherein the improvement comprises that said wedges have a frusto-conical configuration, each said first and second bore has an axially extending frustoconical section corresponding to the frusto-conical configuration of the wedges and an axially extending generally cylindrical section extending axially from the smaller diameter end of said frusto-conical section, said frusto-conical sections in said first bores being located adjacent said first face surface and said cylindrical sections in said first bores extending from the small diameter end of said frustoconical sections approximately to said second face surface and said frusto-conical sections in said second bores being located adjacent said second face surface and said cylindrical section in said second bores extending from the smaller diameter end of said frusto-conical sections approximately to said first face surface with the axial dimensions of said first and second bores between said first and second face surfaces being such that said frusto-conical sections in said first bores are located wholly in the axially extending region of said cylindrical sections in said second bores and are spaced axially from said frusto-conical sections in said second bores, a permanently plastic lubricating corrosion protection material is filled into said first bores, said first and second bores are uniformly distributed over the cross-section of said anchoring member transverse to the direction between the first and second face surfaces thereof, and a second plate on the second face of said anchoring member and forming a cover over said first bores containing said corrosion protection material, said second plate being removably secured to said anchoring so that it can be removed for the subsequent placement of individual elements into said first bores containing said corrosion protection material.

2. Anchoring device, as set forth in claim 1, wherein said second plate has closure plugs thereon for closing said cylindrical sections of said first bores containing said corrosion protection material.

3. Anchoring device, as set forth in claim 2, wherein said closure plugs are integrally formed on said second plate.

4. Anchoring device, as set forth in claim 2 or 3, wherein the outer circumferential surface of said closure plugs have circumferentially extending serrations for forming a secure engagement of said plugs within said bores.

5. Anchoring device, as set forth in claim 4, wherein said second plate and said closure plugs are formed of a plastics material.

6. Anchoring device, as set forth in claim 5, wherein said plastics material is polyethylene.

* * * * *